US012644363B2

(12) United States Patent
Hu et al.

(10) Patent No.: US 12,644,363 B2
(45) Date of Patent: Jun. 2, 2026

(54) DOWNHOLE PUMP INTAKE PRESSURE PREDICTION

(71) Applicant: Halliburton Energy Services, Inc., Houston, TX (US)

(72) Inventors: Yuzhu Hu, Tulsa, OK (US); Frank Corredor, Houston, TX (US); Hans Sjerps, Rijswijk (NL); Casey Laine Newport, Tulsa, OK (US); Joshua Wayne Webster, Tulsa, OK (US); Jason Eugene Hill, Tulsa, OK (US); Clara Susana Tandazo Castro, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 909 days.

(21) Appl. No.: 17/961,750

(22) Filed: Oct. 7, 2022

(65) Prior Publication Data

US 2024/0110473 A1 Apr. 4, 2024

Related U.S. Application Data

(60) Provisional application No. 63/412,829, filed on Oct. 3, 2022.

(51) Int. Cl.
*E21B 43/12* (2006.01)
*E21B 47/008* (2012.01)

(52) U.S. Cl.
CPC ..... *E21B 43/128* (2013.01); *E21B 47/008* (2020.05); *E21B 2200/20* (2020.05); *E21B 2200/22* (2020.05)

(58) Field of Classification Search
None
See application file for complete search history.

(56) References Cited

U.S. PATENT DOCUMENTS 6,937,923 B1 8/2005 Bassett
11,236,751 B2 2/2022 Nguyen et al.
(Continued)

FOREIGN PATENT DOCUMENTS

CN 108756817 A 11/2018
KR 101160678 B1 6/2012
(Continued)

OTHER PUBLICATIONS

Wei et al—A New Method of Bhp Measurement in Esp Deadhead Test—Mar. 2014 (Year: 2014).*
(Continued)

*Primary Examiner* — Juan G Flores
(74) *Attorney, Agent, or Firm* — NOVAK DRUCE CARROLL LLP

(57) ABSTRACT

Systems, methods, and computer-readable media for identifying a wellbore pressure based on a predicted pump intake loss. A pump intake pressure after an intake for a submersible pump deployed downhole in a wellbore is identified. An intake loss prediction model for identifying a virtual intake loss associated with the intake for the submersible pump as a function of one or more intake loss parameters is accessed. The virtual intake loss is identified by applying the intake loss prediction model based on intake loss prediction input of the one or more intake loss parameters. A pump intake pressure before the intake for the submersible pump is determined based on the virtual intake loss and the identified pump intake pressure after the intake.

20 Claims, 7 Drawing Sheets

(56) References Cited

U.S. PATENT DOCUMENTS

| | | | | |
|---|---|---|---|---|
| 11,609,353 | B2 | 3/2023 | Jain et al. | |
| 12,242,260 | B2 * | 3/2025 | Gandikota | F04D 15/0088 |
| 12,385,388 | B2 * | 8/2025 | Kanfar | E21B 47/10 |
| 2005/0173112 | A1 | 8/2005 | Kavaklioglu et al. | |
| 2007/0183902 | A1 | 8/2007 | Stiles, Jr. et al. | |
| 2011/0106452 | A1 | 5/2011 | Anderson et al. | |
| 2013/0151156 | A1 | 6/2013 | Noui-Mehidi et al. | |
| 2019/0345797 | A1 * | 11/2019 | Babic | E21B 47/07 |
| 2022/0090485 | A1 | 3/2022 | Boguslawski et al. | |
| 2022/0098971 | A1 | 3/2022 | Raglin et al. | |
| 2022/0221826 | A1 | 7/2022 | Nguyen et al. | |
| 2023/0107580 | A1 * | 4/2023 | Gandikota | G05B 23/0283 700/28 |
| 2023/0186627 | A1 | 6/2023 | Shao et al. | |
| 2023/0235646 | A1 | 7/2023 | Wang et al. | |
| 2024/0093596 | A1 * | 3/2024 | Kanfar | E21B 43/128 |
| 2024/0169252 | A1 | 5/2024 | Harrington et al. | |
| 2024/0328302 | A1 | 10/2024 | Hu et al. | |

FOREIGN PATENT DOCUMENTS

| | | | | |
|---|---|---|---|---|
| WO | WO-2021155272 | A1 * | 8/2021 | G05B 23/024 |
| WO | 2021252416 | A1 | 12/2021 | |
| WO | 2023009741 | A1 | 2/2023 | |
| WO | 2023056120 | A1 | 4/2023 | |
| WO | 2024205647 | A1 | 10/2024 | |

OTHER PUBLICATIONS

International Search Report & Written Opinion; PCT Application No. PCT/US2023/065293; mailed Dec. 20, 2023.

English abstract of CN108756817A; retrieved from www.espacenet.com on Jan. 10, 2024.

English abstract of KR101160678B1; retrieved from www.espacenet.com on Jan. 10, 2024.

International Search Report & Written Opinion; PCT Application No. PCT/US2023/027253; mailed Nov. 7, 2023.

Abstract of Xian, Wei et al., "A New Method Of Bhp Measurement In Esp Deadhead Test", In: the Offshore Technology Conference—Asia, Kuala Lumpur, Malaysia, Mar. 25-28, 2014; pp. 2-3.

Abstract of Ahmed, Mohamed Foaud Ibrahim et al., "Automatic Well Testing and PIP Calculations Using Smart Rod Pump Controllers", In: the North African Technical Conference and Exhibition, Cairo, Egypt Feb. 20-22, 2012; SPE-150885-MS.

El-Saghier, Rana M. et al., "A model for calculating bottom-hole pressure from simple surface data in pumped wells", Journal of Petroleum Exploration Production Technology, Jun. 2020, vol. 10, Iss. 5, pp. 2069-2077.

International Search Report & Written Opinion; PCT Application No. PCT/US2023/068689; mailed Mar. 6, 2024.

Non-Final Office Action; U.S. Appl. No. 18/193,415; mailed Oct. 30, 2024.

* cited by examiner

DOWNHOLE PUMP INTAKE PRESSURE PREDICTION

CROSS-REFERENCE TO RELATED APPLICATIONS

This application claims benefit to U.S. Provisional Application No. 63/412,829 filed Oct. 3, 2022, which is incorporated herein by reference.

TECHNICAL FIELD

The present technology pertains to determining a pump intake pressure of a submersible pump, and more particularly, to identifying the pump intake pressure based on a predicted accurate downhole intake loss of an intake associated with the pump.

BACKGROUND

In certain wellbore applications, such as geothermal application and oil and gas application, it is important to regulate the wellbore pressure downhole. Specifically, in applications that utilize a pump deployed downhole, e.g. an electric submersible pump ("ESP"), a sensor or pressure transducer can be deployed with the pump downhole to monitor pressure. However, problems exist in the scenario where the downhole sensor for measuring pressure fails. Specifically, once the sensor fails, operation of the pump is ceased and the pump is removed from the well to fix the sensor, despite the pump still being operational.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings.

DETAILED DESCRIPTION

Figure 1:
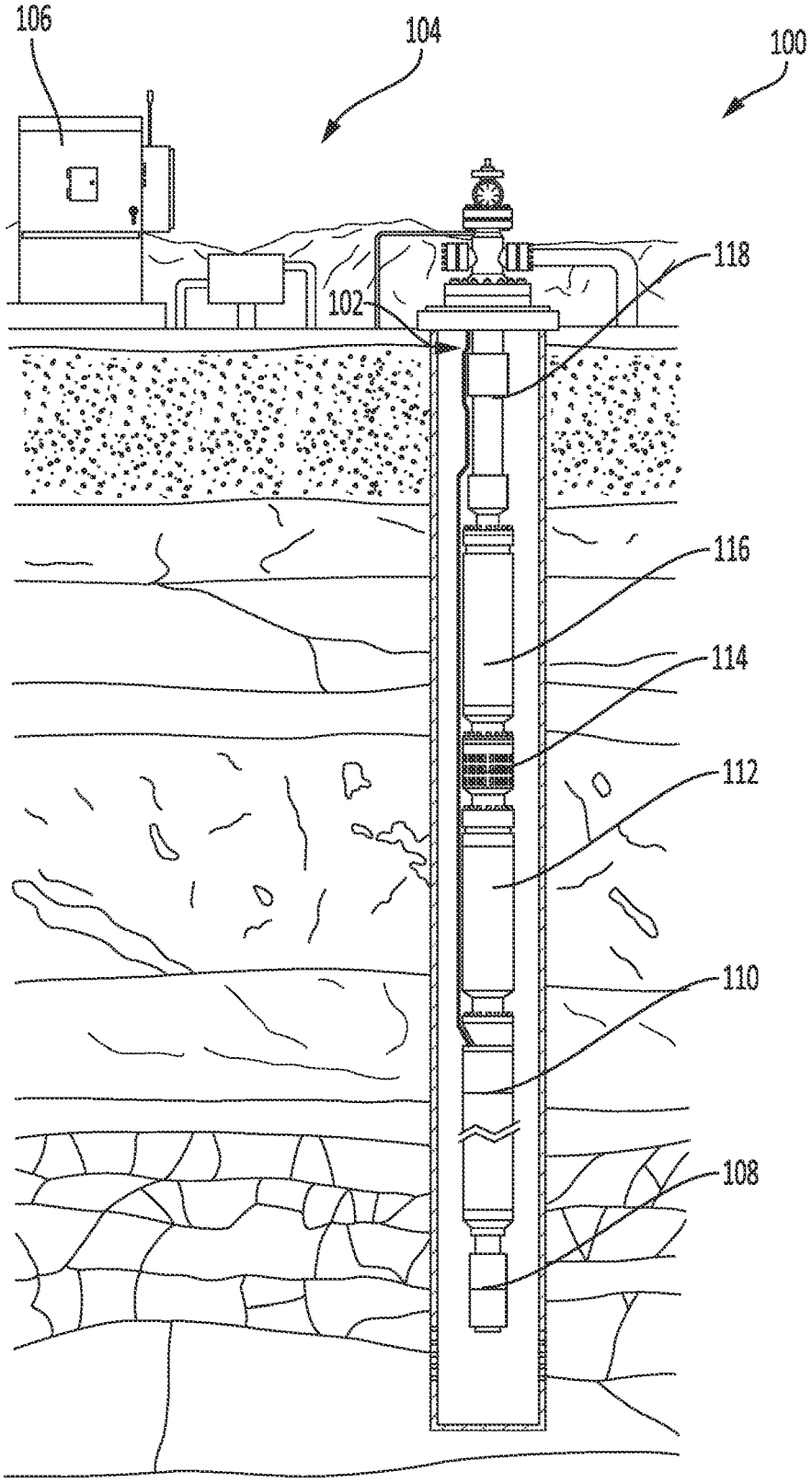
FIG. 1, illustrates a schematic representation of a well environment in a production phase. in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

As discussed previously, in certain wellbore applications, such as geothermal application and oil and gas application, it is important to regulate the wellbore pressure downhole. Specifically, in applications that utilize a pump deployed downhole, e.g. an electric submersible pump ("ESP"), a sensor or pressure transducer can be deployed with the pump downhole to monitor pressure. However, problems exist in the scenario where the downhole sensor for measuring pressure fails. Specifically, once the sensor fails, operation of the pump is ceased and the pump is removed from the well to fix the sensor, despite the pump still being operational.

There is therefore a need for an ability to continue to monitor and report downhole pressure when a downhole pressure sensor associated with a deployed pump fails. Specifically, by being able to continue to monitor and report the downhole pressure, the pump can be left downhole for continues operation. In turn, this can eliminate losses caused by pump downtime in removing the pump from the wellbore and fixing the pressure sensor.

The disclosed technology addresses the foregoing by predicting an intake loss of an intake associated with a pump and identifying the pump intake pressure based on the predicted intake loss of the intake. This pump intake pressure can correspond to a downhole pressure that is monitored during operation of the pump. Specifically, the wellbore pressure can be identified based on other available output parameters that are distinct from pressure readings made by a downhole pressure sensor before the intake. For example, operational parameters such as surface pressure, variable speed drive output, and a pump performance curve can be used to identify wellbore pressure. More specifically, statistical models and fluid mechanic principles can be used to fit a model between intake loss and operating parameters. In turn, the model can be used to predict intake loss and the predicted intake loss can be used in determining downhole pressure. Predicted intake loss and downhole pressure that is determined based on the predicted intake loss can be found through the modeling when a downhole pressure sensor fails. Alternatively, identified or otherwise predicted intake loss and downhole pressure that is determined based on the identified loss can be found through the modeling when the downhole pressure sensor is still active. In turn, measured data generated by the downhole pressure sensor can be validated from the identified intake loss and determined downhole pressure.

In various embodiments, a method can include identifying a pump intake pressure after an intake for a submersible pump deployed downhole in a wellbore for pumping a substance out of the wellbore. The method can also include accessing an intake loss prediction model for identifying a virtual intake loss associated with the intake for the submersible pump as a function of one or more intake loss parameters. Further, the method can include identifying the virtual intake loss by applying the intake loss prediction model based on intake loss prediction input of the one or more intake loss parameters. Additionally, the method can include determining a pump intake pressure before the intake for the submersible pump based on the virtual intake loss and the identified pump intake pressure after the intake.

In various embodiments, a system can include a submersible pump deployed downhole in a wellbore for pumping a substance out of the wellbore. Further, the system can include one or more processors and at least one computer-readable storage medium storing instructions which, when executed by the one or more processors, cause the one or more processors to identify a pump intake pressure after an intake for the submersible pump. The instructions can also cause the one or more processors to access an intake loss prediction model for identifying a virtual intake loss associated with the intake for the submersible pump as a function of one or more intake loss parameters. Further, the instructions can cause the one or more processors to identify the virtual intake loss by applying the intake loss prediction model based on intake loss prediction input of the one or more intake loss parameters. Additionally, the instructions can cause the one or more processors to determine a pump intake pressure before the intake for the submersible pump based on the virtual intake loss and the identified pump intake pressure after the intake.

In various embodiments, non-transitory computer-readable storage medium has stored therein instructions which, when executed by one or more processors, can cause the one or more processors to identify a pump intake pressure after an intake for a submersible pump deployed downhole in a wellbore for pumping a substance out of the wellbore. The instructions can also cause the one or more processors to access an intake loss prediction model for identifying a virtual intake loss associated with the intake for the submersible pump as a function of one or more intake loss parameters. Further, the instructions can cause the one or more processors to identify the virtual intake loss by applying the intake loss prediction model based on intake loss prediction input of the one or more intake loss parameters. Additionally, the instructions can cause the one or more processors to determine a pump intake pressure before the intake for the submersible pump based on the virtual intake loss and the identified pump intake pressure after the intake.

The disclosure now turns to a description of FIG. 1, which illustrates a schematic representation of a well environment 100 in a production phase. The well environment 100 can represent an applicable environment in which a substance is pumped through the wellbore 102 toward the surface. For example, the well environment 100 can represent a hydrocarbon production environment in which hydrocarbons are pumped through the wellbore 102 toward the surface. In another example, the well environment 100 can represent a geothermal environment in which water is pumped through the wellbore 102 toward the surface.

The well environment 100 includes a production system 104 disposed in relation to the wellbore 102. The production system 104 includes a surface control system 106. The production system 104 also includes components disposed downhole in the wellbore 102. Specifically, the production system 104 includes a gauge 108, a motor 110, a seal section 112, a gas separator 114, a pump 116, and a power cable 118. The components of the production system 104, in combination, function to form various tasks related to pumping a substance through the wellbore 102 toward the surface. In particular, the surface control system 106 functions to control and interact with the various downhole components for performing various tasks related to pumping a substance through the wellbore 102 towards the surface.

The gauge 108 functions to generate downhole data of one or more monitored parameters. Specifically, the downhole data can include applicable data that is capable of being measured downhole. When a first component or first point is described as being before a second component or second point, the first component or point can be positioned further in a wellbore than a second component or point. For example, the gauge 108 can include a pressure gauge that is configured to identify a wellbore pressure before the pump 116, e.g. before a pump intake or gas separator. Further the gauge 108 can function to measure parameters for preventing or reducing formation damage cause by over-production through the wellbore 102. The gauge 108 can communicate with the surface control system 106 in generating downhole data. Specifically, the gauge 108 can provide the downhole data as telemetry data to the surface control system 106, where the downhole data can be used in controlling production operation of the production system 104.

The motor 110 functions to drive the pump 116. Specifically, the motor 110 can receive power from the surface through the power cable 118 to drive the pump 116 in lifting production substance towards the surface. The motor 110 can be an applicable motor that is capable of driving the pump 116, such as an electrical submersible pump ("ESP). Correspondingly, the pump 116 can be an applicable pump that is capable of pumping production substances toward the surface of the wellbore 102, such as an ESP. The seal section 112 is disposed between the motor 110 and the intake of the pump 116. The seal section 112 functions to isolate the motor 110 from downhole fluids. The seal section 112 also can function to equalize pressure in the wellbore 102 with pressure in the motor 110.

The gas separator 114 is positioned between the pump 116 and the sealing section 112 and motor 110 combination. The gas separator 114 can serve, at least in part, as an intake for the pump 116. In particular, the gas separator 114 can function to separate gas from fluid in the wellbore and allow for the entry of the separated fluid into the pump 116. In turn, the pump 116 can pump the separate fluid towards the surface as part of a production substance. The separated fluid that is fed to the pump 116 can include portions of the separated gas that are broken down and incorporated into the fluid to form a more homogenized solution.

The disclosure now continues with a discussion of techniques for overcoming the previously described deficiencies with respect to downhole pressure sensors and identifying downhole pressures when the downhole pressure sensors fail. Specifically, the disclosure now continues with a discussion of techniques for predicting intake loss and identifying downhole pressures based on the predicted intake loss. Various metrics are discussed in relation to the techniques for predicting intake loss and identifying downhole pressures based on the predicted intake loss. These metrics include metrics associated with a production system, such as production system 104, disposed in a wellbore in relation to a pump of the production system.

Figure 2:
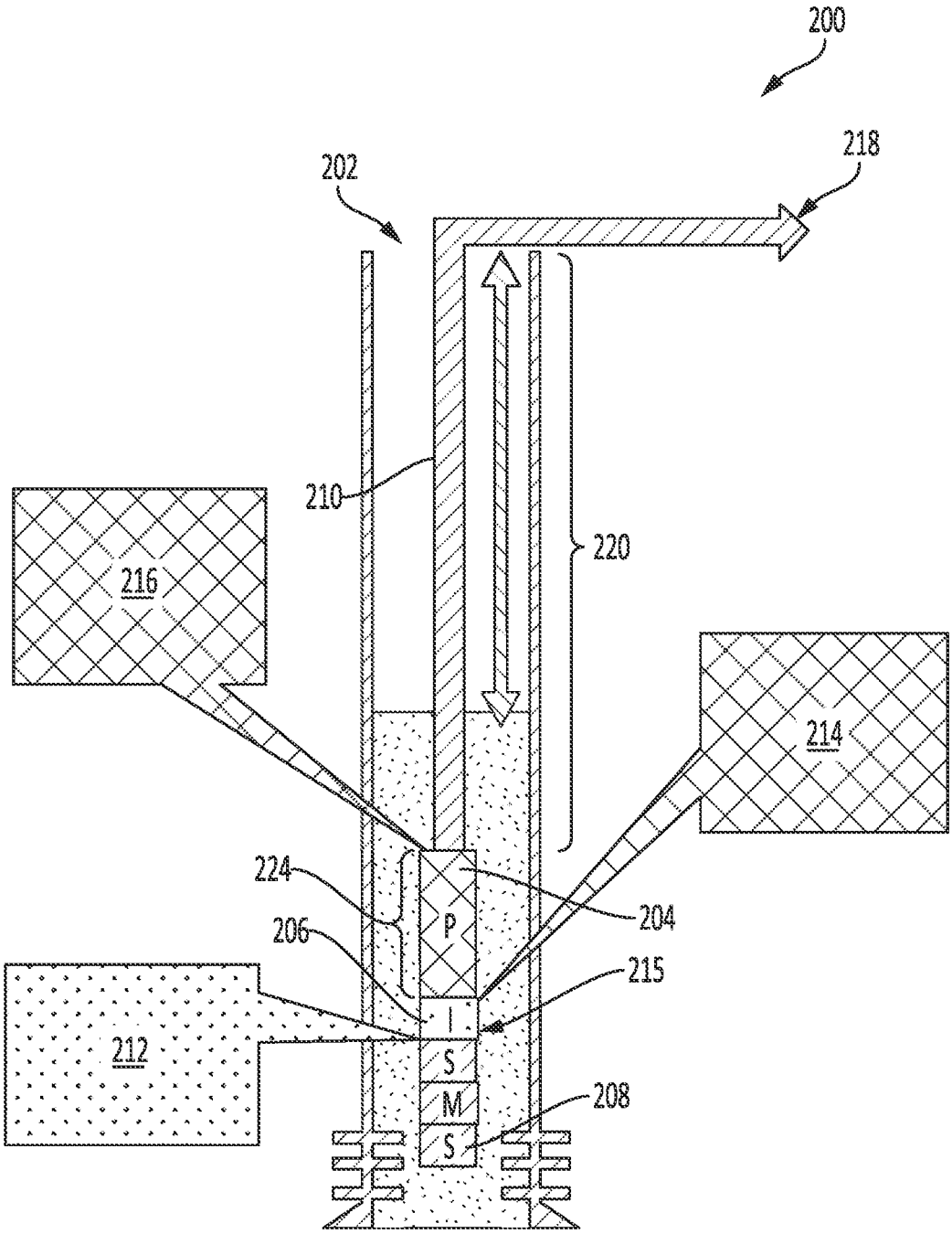
FIG. 2 illustrates a schematic representation of a production system in a wellbore with indicated metrics in relation to the production system in the wellbore for identifying downhole pressure based on a predicted intake loss, in accordance with various aspects of the subject technology.

FIG. 2 illustrates a schematic representation of a production system 200 in a wellbore 202 with indicated metrics in relation to the production system 200 in the wellbore 202 for identifying downhole pressure based on a predicted intake loss. The production system 200 can be an applicable production system that is deployed downhole in a wellbore for pushing production substances toward the surface, such as the production system 104. Further, the production system 200 shown in FIG. 2 is a schematic representation of the production system 200 and the production system 200 can include more components.

The production system 200 includes a pump 204, an intake 206 for the pump 204, a gauge 208, and production tubing 210. The techniques described herein can be applied to identify a pump intake pressure before the intake 212. Specifically, the techniques described herein can be applied to identify a pump intake pressure before the intake 212 based on a predicted intake loss of the intake 206. The pump intake pressure before the intake 212 can correspond to a monitored wellbore pressure. Specifically, the pump intake pressure before the intake 212 can correspond to a wellbore pressure that is monitored by the gauge 208. Accordingly, the pump intake pressure before the intake 212 can serve as a substitute for a pressure monitored by the gauge 208, e.g. in the case of gauge 208 failure. Further, the pump intake pressure before the intake 212 can serve to validate a pressure that is calculated based on data measured by the gauge 208.

The techniques applied herein can also be applied to identify a pump intake pressure after the intake 214. The pump intake pressure after the intake 214 is a pressure after the intake 206 and before the pump 204 in a flow of substance through the intake 206 and into the pump 204. As will be discussed in greater detail later, the pump intake pressure after the intake 214 can be used in identifying the pump intake pressure before the intake 212. Specifically, the pump intake pressure before the intake 212 can be the sum of the pump intake pressure after the intake 214 and an intake loss 215 that is created in the intake 206.

The intake loss 215 is representative of loss associated with production substance flow in the intake 206, through the intake 206, and out the intake 206, but also expected to include the friction loss and minor loss associated with the fluid flow in wellbore 202 annulus, e.g. loss up to intake 206. This loss can be created due to applicable factors that affect substance flow in relation to a pump intake. Specifically, the intake loss 215 can be caused by loss through the intake 206 due to changing cross sectional areas associated with the intake 206 and through which fluid flows. For example, the intake loss 215 can be caused by a narrowing fluid channel through the intake 206. Further, the intake loss 215 can be caused by friction loss associated with fluid passing through the intake 206. For example, the intake loss 215 can be caused by friction loss as a substance interacts with surfaces of the intake 206 as the substance flows through the intake 206.

Further, intake loss, as used herein, is not strictly limited to a pump intake but can include other applicable related downhole losses that affect downhole flow of a production substance. These downhole pressure head losses can include losses that are created after the intake, e.g. towards production reservoirs. For example, intake loss can include losses created by friction with the casing of the wellbore. The intake loss 215 could also be friction loss due to changing cross sectional areas associated with the wellbore flow path, e.g. due to annules cross sectional areas change.

The techniques applied herein can also be applied to identify a discharge head 216 of the pump 204. A discharge head of a pump, as used herein, is a pressure metric or other representation of pressure at the discharge of the pump 204. For example, the discharge head 216 of the pump 204 can be represented as the distance that a pump can pump a substance. More specifically, the discharge head 216 can include that the pump 204 is capable of pumping a substance 25 feet.

The discharge head 216 of the pump 204 can depend on numerous parameters. Specifically and as will be discussed in greater detail later, the discharge head 216 of the pump can depend on a wellhead head parameter 218, a tubing loss parameter 220, and a static head parameter. The wellhead head parameter 218 is a pressure metric or other representation at a wellhead of the wellbore 202. The tubing loss parameter 220 is a loss that is introduced in pumping the substance from the pump 204 to the wellhead of the wellbore 202 through the production tubing 210. For example, the tubing loss parameter 220 can include the amount of friction loss that is created by pumping through the production tubing 210. The static head parameter is the head required to push the production substance from the flowing production substance level to the surface.

The techniques applied herein can also be applied to identify a total pump head 224 for the pump 204. The total pump head 224 is a metric that represents the total distance that the pump 204 can pump a substance when viewed in the entire production system 200. The total pump head 224 is a function of both the operating frequency of the pump 204 and the flow rate associated with the pump 204.

Figure 3:
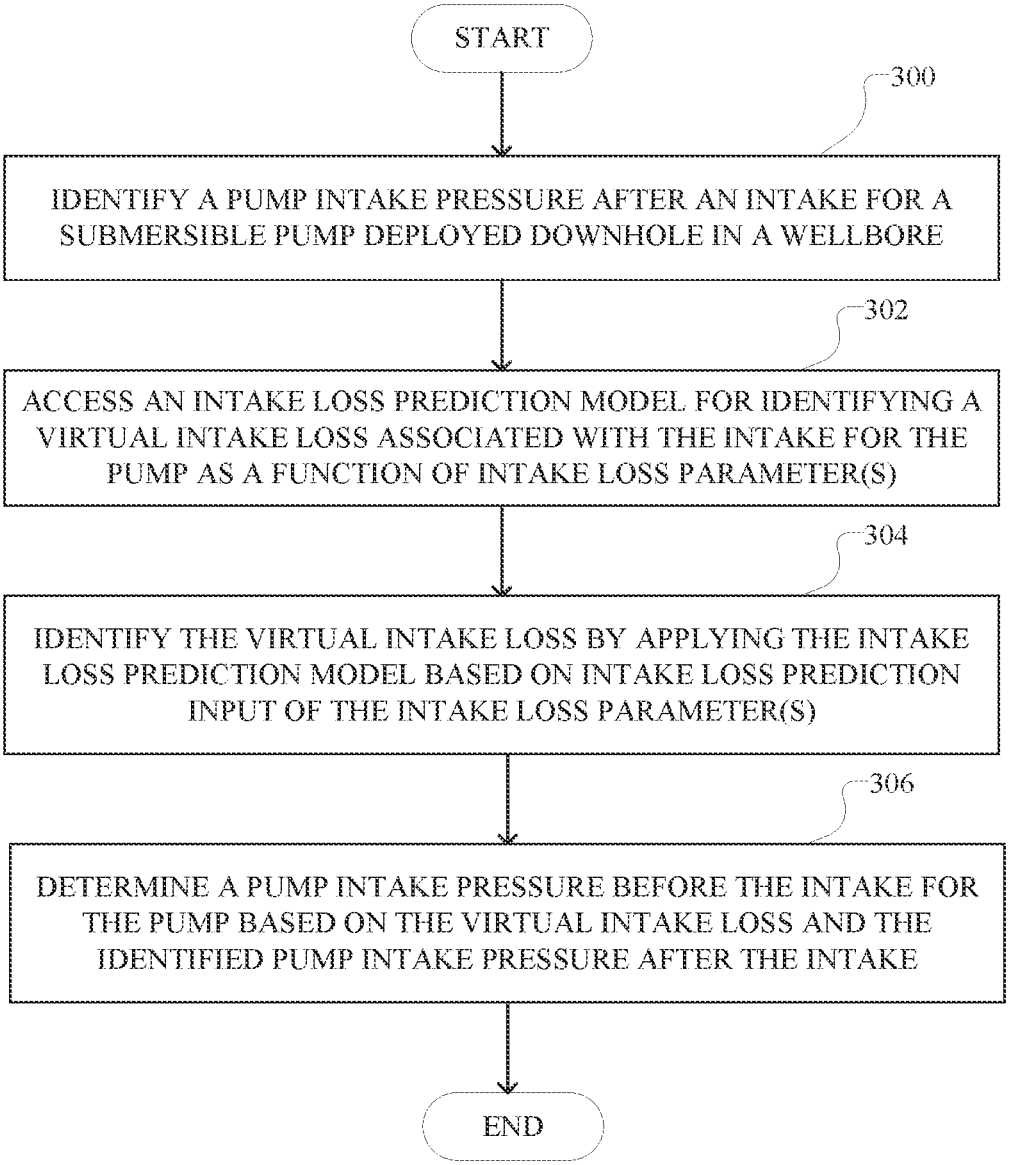
FIG. 3 illustrates a flowchart for an example method of identifying downhole pressure based on a predicted intake loss, in accordance with various aspects of the subject technology.

The disclosure now continues with a discussion of techniques for predicting intake loss of a production system and identifying a downhole pressure based on the predicted intake loss. Specifically, FIG. 3 illustrates a flowchart for an example method of identifying downhole pressure based on a predicted intake loss. The method shown in FIG. 3 is provided by way of example, as there are a variety of ways to carry out the method. Additionally, while the example method is illustrated with a particular order of steps, those of ordinary skill in the art will appreciate that FIG. 3 and the modules shown therein can be executed in any order and can include fewer or more modules than illustrated. Each module shown in FIG. 3 represents one or more steps, processes, methods or routines in the method. The method shown in FIG. 3 will be discussed with respect to the production system 200 and the various metrics shown in FIG. 2.

At step 300, a pump intake pressure after an intake for a submersible pump deployed in a wellbore is identified. More specifically and with reference to FIG. 2, the pump intake pressure after the intake 214 is identified. While the technology described herein is discussed with respect to a pump intake, the techniques described herein can be applied to a gas separator in a production system. The pump intake pressure after the intake can be identified through an applicable technique for identifying pressure after an intake in a downhole environment. Specifically, the pump intake pressure after the intake can be identified through various monitored parameters, calculated parameters, and specified parameters. For example and as will be discussed in greater detail later, the pump intake pressure after the intake can be identified based on a static head parameter, a tubing loss parameter, and a wellhead head parameter. In various embodiments, the pump intake pressure after the intake can be identified using another applicable technique.

Further, the pump intake pressure after the intake can be identified based on a total pump head parameter. As a total pump head parameter can be dependent on both the flow rate and operational frequency, the pump intake pressure after the intake can be dependent on such operational parameters. For example, the pump intake pressure after the intake can be identified based on a number of pump stages at specific operational frequencies of a production system. Specifically, the pump intake pressure after the intake can be identified based on the pump head per stage at specific operational frequencies.

At step 302, an intake loss prediction model for identifying a loss associated with the intake for the pump, otherwise referred to as a virtual intake loss, is accessed. An intake loss identified by the intake loss prediction model can be a predicted intake loss that will occur at a different time, e.g. in the future. Further, an intake loss identified by the intake loss prediction model can be an intake loss that is determined in real time. Real time, as used herein, can include actual time, virtually immediately, or within a threshold range to actual time. Real time can include calculations made with respect to the last time data was measured downhole by one or more sensors. Regardless of whether the model is used to predict an intake loss at a different time or identify an intake loss in real time, an intake loss that is identified through the model can be referred to as a virtual intake loss. Specifically, an intake loss determined through the model can be a virtual intake loss as, in various embodiments, it is not directly identified from measurements used to calculate a downhole pressure before the intake.

An intake loss prediction model is a model that relates intake loss to one or more intake loss parameters. More specifically, and with reference to FIG. 2, an intake loss prediction model can model the intake loss 215 as a function of one or more intake loss parameters. As discussed previously, the intake loss 215 is representative of a loss associated with production substance flow into the intake 206, a loss associated with production substance flow through the intake 206, and loss associated with production subset flow out of the intake 206. Further, the intake loss 215 can also include other applicable downhole losses, e.g. associated with the intake. Accordingly, an intake loss prediction model can model an applicable combination of these losses as a function of one or more intake loss parameters.

Intake loss parameters, as used herein, are applicable parameters that affect intake loss in a production system. The parameters can be monitored parameters. For example, intake loss parameters can include a flowrate parameter associated with a flowrate through a production system, a frequency parameter associated with an operational frequency of a production system, and a wellhead head parameter associated with a pressure at a wellhead of a wellbore. Further, the parameters can be calculated parameters. For example, the parameters can include a tubing loss parameter associated with loss through production tubing of a production system and a total pump head parameter associated with a total pump head of a pumping system. Intake loss parameters can also include a wellhead temperature parameter, a flowline pressure parameter, an injection pressure parameter, an injection temperature parameter, a differential pressure parameter, a valve choke parameter, a surface valve opening parameter, a motor current parameter, a motor voltage parameter, and other applicable downhole and surface parameters.

An intake loss prediction model, as will be described in greater detail later, can be a physical model. A physical model can be generated based only on an intake loss parameter of flowrate. Specifically, a physical model can model intake loss at a varying flow rate to account for major losses and minor losses associated with a pump intake. Major losses can correspond to well friction losses and be modeled according to Darcy's equation. In various embodiments, a physical model can be created using other techniques. Minor losses can correspond to losses created by sudden expansions, contractions, and fittings. A physical model can be generated based on one or more applicable intake loss parameters, such as the previously described intake loss parameters.

Further, an intake loss prediction model, as will be described in greater detail later, can be a machine learning-based model. Specifically, a machine learning-based model can model intake loss based on varying intake loss parameters of a flowrate parameter, a frequency parameter, a wellhead head parameter, a tubing loss parameter, a pump head parameter, a wellhead temperature parameter, a flowline pressure parameter, an injection pressure parameter, an injection temperature parameter, a differential pressure parameter, a valve choke parameter, a surface valve opening parameter, a motor current parameter, a motor voltage parameter, or a combination thereof. These parameters are merely examples, and different parameters can be used. Further, fewer or more parameters can be used. As the machine learning-based model can account for the different intake loss parameters, the machine learning-based model can perform functions that are not easily performed by a human. Specifically, modeling intake loss across the ranges of these numerous intake loss parameters is difficult for a human to perform in their own mind. Further, by accounting for different intake loss parameters and not just flowrate, the machine learning-based model can account for previously described downhole losses that are called intake losses for the purposes of this disclosure, but that are not limited the losses occurring in a pump intake. In turn, this can increase an overall accuracy of an intake loss prediction model, e.g. in comparison to a model that is purely a physical model.

An intake loss prediction model can be generated based on a calculated intake loss. Calculated intake loss, as used herein, is an intake loss that is calculated directly from measurements associated with one or more downhole sensors, one or more surface sensors, one or more installation conditions, or a combination thereof. Specifically, an intake loss prediction model can be generated based on a measured pump intake pressure before the intake. More specifically and with reference to FIG. 2, the intake loss prediction model can be generated based on a calculated intake loss that is identified from the pump intake pressure before the intake 212 that is directly measured by the gauge 208. Further and as will be discussed in greater detail later, the intake loss prediction model can be generated based on a pump intake pressure after intake that is calculated from measurements. Specifically, the intake loss prediction model can be generated based on a calculated intake loss that is identified from the pump intake pressure after intake 214 that is calculated from measurements.

At step 304, the virtual intake loss is identified by applying the intake loss prediction model based on intake loss prediction input of the intake loss parameters. Intake loss prediction input, as used herein, includes values of the intake loss parameters that can be applied to the intake loss prediction model for determining an intake loss. For example, intake loss prediction input can include values of a flowrate parameter, a frequency parameter, a wellhead head parameter, a tubing loss parameter, a pump head parameter, other applicable intake loss parameters, such as the other intake loss parameters described herein, or a combination thereof.

The intake loss prediction input that is applied to the intake loss prediction model can depend on whether the model is a physical model or a machine learning-based model. Specifically, the intake loss prediction input that is applied to the intake loss prediction model can depend on the intake loss parameters that are used in generating the intake loss prediction model. For example, if a flowrate parameter is used to generate the intake loss prediction model, e.g. a physical model, then values of the flowrate parameter can serve as the intake loss prediction input to the model. In another example, if a flowrate parameter, a frequency parameter, a wellhead head parameter, a tubing loss parameter, a pump head parameter, or a combination thereof are used to generate the intake loss prediction model, e.g. a machine learning-based model, then values of these corresponding parameters can serve as the intake loss prediction input to the model.

The intake loss prediction input can have a temporal aspect. Specifically, the intake loss prediction input can correspond to values of intake loss parameters at a specific time or time frame. In turn, the virtual intake loss that is identified based on the intake loss prediction input can correspond to the specific time or time frame. Accordingly, intake loss prediction input can be identified in real time and applied to identify a virtual intake loss for a production system in real time.

At step 306, a pump intake pressure before the intake is determined for the pump/pump system based on the identified virtual intake loss. Specifically, the pump intake pressure before the intake can be determined based on the virtual intake loss and the identified pump intake pressure after the intake. More specifically and with reference to FIG. 2, the pump intake pressure before the intake 212 can be determined based on the identified virtual intake loss 215 and the identified pump intake pressure after the intake 214.

While an intake loss prediction model can be generated based on a measured pump intake pressure before intake, the intake loss prediction model can be applied to identify a virtual intake loss. In turn, the virtual intake loss can be applied to determine a pump intake pressure before the intake that is distinct from the measured pump intake pressure before intake. As follows, this determined pump intake pressure before the intake can be referred to as a virtual pump intake pressure because, in various embodiments, it is not measured or otherwise calculated directly from measurements and instead determined from a predicted intake loss or an intake loss calculated, e.g. in real time, from a model. By being distinct from the measured pump intake pressure, the virtual pump intake pressure can serve to validate the measured pump intake pressure. Further, by being distinct from the measured pump intake pressure, the virtual pump intake pressure can supplement the measurement.

Figure 4:
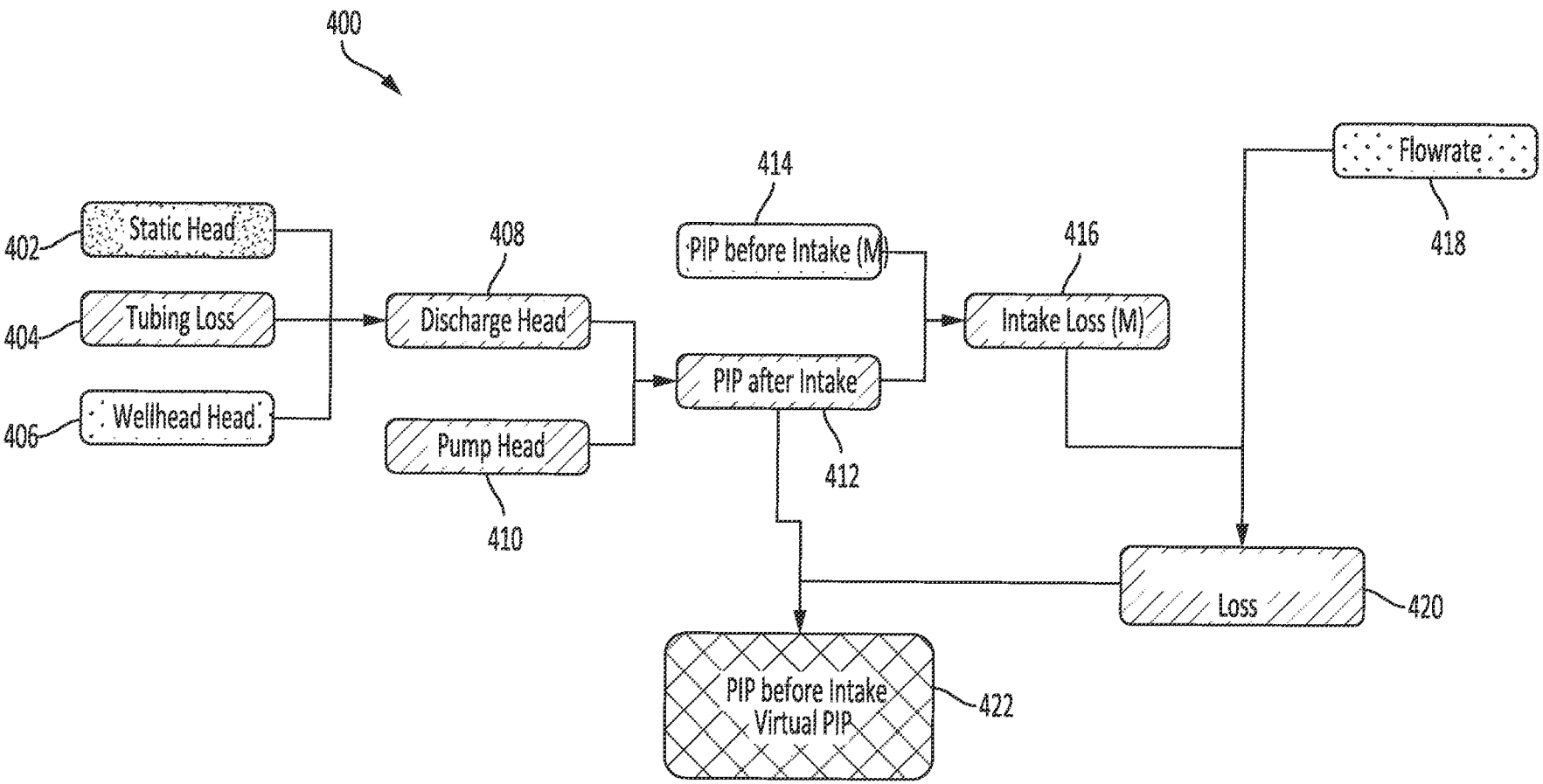
FIG. 4 is a schematic representation of a flow for identifying a pump intake pressure before an intake for a pump based on an intake loss that is identified through application of a physical model, in accordance with various aspects of the subject technology.

FIG. 4 is a schematic representation of a flow 400 for identifying a pump intake pressure before an intake for a pump based on an intake loss that is identified through application of a physical model. The flow 400 can be applied to an applicable production system to identify a pump intake pressure before an intake, such as the production systems shown in FIGS. 1 and 2.

At operation 402, a static head parameter of a pump of a production system in a wellbore is identified. The static head parameter can be identified based on applicable characteristics of the production system related to static head. Specifically, the static head can be identified based on both the tubing length and pump length, e.g. the addition of both the tubing length and the pump length in the production system. As follows, the static head can be expressed as a unit of length. The static head parameter can be identified from an applicable source of information related to the static head parameter. For example, the static head parameter can be identified by a manufacturer of the production system or components of the production system, e.g. the pump.

At operation 404, a tubing loss parameter associated with production tubing of the production system is identified. The tubing loss parameter can be identified based on applicable characteristics of the production system related to tubing loss. Specifically, the tubing loss parameter can be calculated based on production tubing length as well as operational parameters of the production system, such as an operating flowrate of the production system. Specifically, a tubing loss per unit of length can be determined based on characteristics of the production tubing and an operational flowrate of the production system. Then, the tubing loss can be combined with the production tubing length to identify a total tubing loss corresponding to the tubing loss parameter. The tubing loss parameter can be expressed as a length unit of measurement, e.g. feet.

At operation 406, a wellhead head parameter of a wellhead of the wellbore is identified. The wellhead head parameter can be identified by monitoring pressure at a wellhead of the wellbore, e.g. during operation of the production system. Specifically, the wellhead parameter can be identified based on measurements made by a pressure gauge at the wellhead of the wellbore.

At operation 408, a discharge head parameter of the production system is identified. As discussed previously, the discharge head parameter corresponds to a pressure at a discharge of the pump of the production system. The discharge head parameter, as shown in the flow 400, is determined based on a combination of the static head parameter, the tubing loss parameter, and the wellhead head parameter. Specifically, the discharge head parameter can be determined by summing the wellhead head parameter, the tubing loss parameter, and the static head parameter. Each of these parameters can be in a length unit of measurement form. Specifically, the wellhead head parameter can be converted to a length unit of measurement by dividing the measured wellhead pressure by a specific gravity associated with a production substance. In various embodiments the discharge head parameter can be identified through different techniques.

At operation 410, a total pump head parameter is identified. As discussed previously, total pump head parameter is a metric that represents the total distance that the pump can pump a production substance when viewed in the entire production system. Specifically, the total pump parameter can vary based on both an operational flowrate of the production system and an operational frequency of the production system.

The total pump head parameter can be identified based on a production stage. Specifically, the total pump head parameter can be identified based on a production stage. Stages can be separated based on an operational frequency of the production system. For example, a stage can include while the production system is operating at 60 Hz. The total pump head can be identified by combining the pump head parameter across stages, e.g. by multiplying the pump head per stage by the number of pumping stage.

At operation 412, a pump intake pressure after intake for the production system is identified. Specifically, the pump intake pressure after intake can be identified based on both the discharge head determined at operation 408 and the pump head determined at operation 410. More specifically, the pump intake pressure after intake for the production system can include the difference between the discharge head parameter determined at operation 408 and the pump head parameter determined at operations 410. In various embodiments, a pump intake pressure after intake can be identified through different techniques.

At operation 414, a pump intake pressure before intake for the production system is measured. The pump intake pressure before intake that is determined at operation 414 is read from sensor measurements made while the production system is deployed and operated in the wellbore. Specifically, the pump intake pressure before intake that is measured at operation 414 can be read from measurements made by one or more gauges deployed downhole with the production system, e.g. gauge 208.

At operation 416, a calculated intake loss is identified. Specifically, the calculated intake loss is identified based on the pump intake pressure before intake that is measured at operation 414 and the pump intake pressure after intake that is determined at operation 412. More specifically, the calculated intake loss can be the difference between the pump intake pressure before intake that is measured at operation 414 and the pump intake pressure after intake that is determined at operation 412. As the intake loss that is identified at operation 416 is determined based on the measured pump intake pressure before intake, the intake loss identified at operation 416 is referred to as a calculated intake loss.

At operation 418, a flowrate of the production system is identified. The flowrate of the production system can be monitored during operation of the production system. Further, the flowrate of the production system can correspond to the pump intake pressure before intake that is measured at operation 414 and the corresponding calculated intake loss that is determined at operation 416. For example, measured pump intake pressures before intake and corresponding calculated intake losses can occur at specific measured flowrates of the production system.

In turn, the identified flowrate of the production system and the calculated intake loss can be used in generating a physical intake loss prediction model. Specifically, measured flowrates and corresponding calculated intake losses can serve as a basis for a physical intake loss prediction model. The physical intake loss prediction model can model flowrates of the production system to predicted intake loss values. The model can be specific to the production system, the production system disposed in the wellbore, the wellbore itself, a target production substance, or a combination thereof. In various embodiments, other parameters distinct from the flowrate parameter can be used to generate the physical model.

At operation 420, the physical intake loss prediction model that is generated based on the calculated intake loss and the identified flowrate is applied to identify a virtual intake loss, e.g. predicted intake loss or determined real time intake loss. The intake loss can be identified separate from the intake loss that is calculated at operation 416. In turn, the virtual intake loss that is determined at operation 420 is a distinct value from the calculated intake loss that is identified at operation 416. In applying a physical intake loss prediction model, a measured flowrate of the production system can be applied as input to the model for identifying the virtual intake loss.

At operation 422, a pump intake pressure before intake is identified based on the virtual intake loss at operation 420 and the pump intake pressure after intake that is determined at operation 412. Specifically, the virtual intake loss can be summed with the identified pump intake pressure after intake to identify the pump intake pressure before intake at operation 422. The pump intake pressure after intake that is determined at operation 412 can be identified from measurements. Further and as shown in FIG. 4, the pump intake pressure before intake is not determined, at operation 422, directly from the pump intake pressure before intake that is measured at operation 414. As a result, the identified pump intake pressure before the intake is a distinct value from the measured pump intake pressure before the intake.

Figure 5:
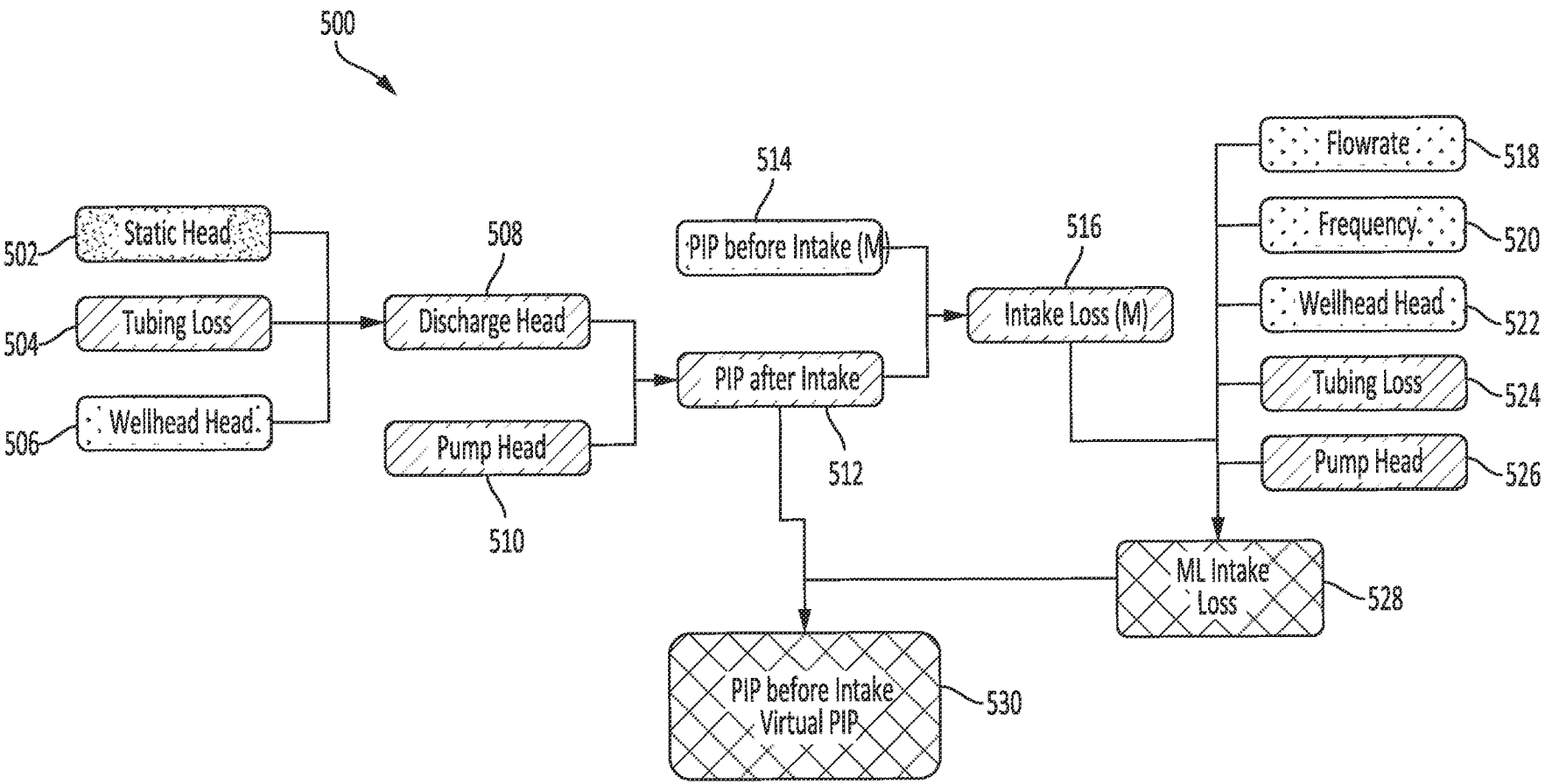
FIG. 5 is a schematic representation of a flow for identifying a pump intake pressure before an intake for a pump based on an intake loss that is identified through application of a machine learning-based model, in accordance with various aspects of the subject technology.

FIG. 5 is a schematic representation of a flow 500 for identifying a pump intake pressure before an intake for a pump based on an intake loss that is calculated through application of a machine learning-based model. The flow 500 can be applied to an applicable production system to identify a pump intake pressure before an intake, such as the production systems shown in FIGS. 1 and 2.

Various operations in the flow 500 shown in FIG. 5 are the same operations as those performed in the flow 400 shown in FIG. 4. At operation 502, a static head parameter of a pump of a production system in a wellbore is identified. At operation 504, a tubing loss parameter is identified. At operation 506, a wellhead head parameter is identified. At operation 508, a discharge head parameter is identified. At operation 510, a pump head parameter is identified. At operation 512, a pump intake pressure after intake is identified, e.g. calculated based on measurements. At operation 514, a pump intake pressure before intake is measured. At operation 516, a calculated intake loss is identified.

At operation 518, the flowrate parameter of the production system is identified. At operation 520, the frequency parameter of the production system is identified. At operation 522, the wellhead head parameter is identified. At operation 524, the tubing loss parameter is identified. At operation 526, the pump head parameter is identified. In turn, a machine learning-based model can be generated based on one or a combination of the flowrate parameter, the frequency parameter, the wellhead head parameter, the tubing loss parameter, and the pump head parameter. Specifically, measured flowrates, measured operational frequencies, measured wellhead head, determined tubing loss, determined pump head, and corresponding measured intake losses can serve as a basis for a machine learning-based intake loss prediction model. In various embodiments, other intake loss parameters can be used to generate the machine learning-based intake loss prediction model.

The model can be specific to the production system, the production system disposed in the wellbore, the wellbore itself, a target production substance, or a combination thereof. An applicable machine learning technique can be applied to generate the machine learning-based intake loss prediction model. For example and as will be discussed in greater detail later, the model can be generated through a neural network.

At operation 528, the machine learning-based intake loss prediction model is applied to identify a virtual intake loss. The virtual intake loss can be identified separate from the calculated intake loss that is identified at operation 516. In turn, the virtual intake loss that is determined at operation 528 is a distinct value from the calculated intake loss that is identified at operation 516. In applying the machine learning-based intake loss prediction model, a measured flowrate of the production system, an operational frequency of the production system, a wellhead head of the production system, a tubing loss of the production system, a pump head of the production system, or a combination thereof can be applied as input to the model for determining the virtual intake loss.

At operation 530, a pump intake pressure before intake is identified based on the virtual intake loss at operation 528 and the pump intake pressure after intake that is determined at operation 512. Specifically, the predicted intake loss can be summed with the determined pump intake pressure after intake to identify the pump intake pressure before intake at operation 530. As shown in FIG. 5, the pump intake pressure before intake is not identified, at operation 530, directly from the measured pump intake pressure before intake, that is identified at operation 514. As a result, the predicted pump intake pressure before intake is a distinct value from the measured pump intake pressure before intake.

Figure 6:
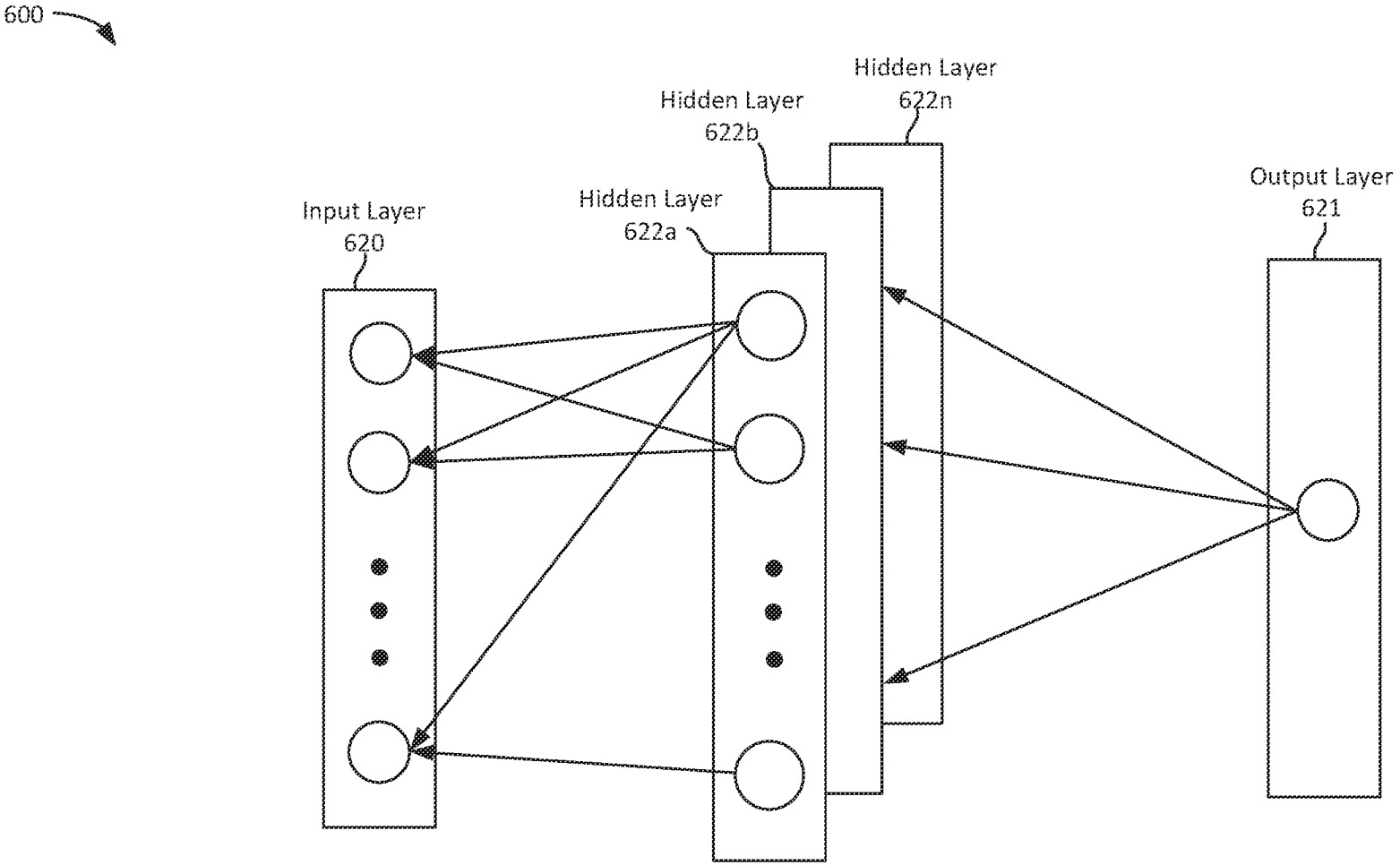
FIG. 6 illustrates a schematic representation of an example of a deep learning neural network in accordance with various aspects of the subject technology.

In FIG. 6, the disclosure now turns to a further discussion of models that can be used through the environments and techniques described herein. FIG. 6 is an example of a deep learning neural network 600 that can be used to implement all or a portion of the systems and techniques described herein (e.g., neural network 600 can be used to implement a perception module (or perception system) as discussed above). An input layer 620 can be configured to receive sensor data and/or data relating to an environment. The neural network 600 includes multiple hidden layers 622*a*, 622*b*, through 622*n*. The hidden layers 622*a*, 622*b*, through 622*n* include "n" number of hidden layers, where "n" is an integer greater than or equal to one. The number of hidden layers can be made to include as many layers as needed for the given application. The neural network 600 further includes an output layer 621 that provides an output resulting from the processing performed by the hidden layers 622*a*, 622*b*, through 622*n*. In one illustrative example, the output layer 621 can provide estimated treatment parameters.

The neural network 600 is a multi-layer neural network of interconnected nodes. Each node can represent a piece of information. Information associated with the nodes is shared among the different layers and each layer retains information as information is processed. In some cases, the neural network 600 can include a feed-forward network, in which case there are no feedback connections where outputs of the network are fed back into itself. In some cases, the neural network 600 can include a recurrent neural network, which can have loops that allow information to be carried across nodes while reading in input.

Information can be exchanged between nodes through node-to-node interconnections between the various layers. Nodes of the input layer 620 can activate a set of nodes in the first hidden layer 622*a*. For example, as shown, each of the input nodes of the input layer 620 is connected to each of the nodes of the first hidden layer 622*a*. The nodes of the first hidden layer 622*a* can transform the information of each input node by applying activation functions to the input node information. The information derived from the transformation can then be passed to and can activate the nodes of the next hidden layer 622*b*, which can perform their own designated functions. Example functions include convolutional, up-sampling, data transformation, and/or any other suitable functions. The output of the hidden layer 622*b* can then activate nodes of the next hidden layer, and so on. The output of the last hidden layer 622*n* can activate one or more nodes of the output layer 621, at which an output is provided. In some cases, while nodes in the neural network 600 are shown as having multiple output lines, a node can have a single output and all lines shown as being output from a node represent the same output value.

In some cases, each node or interconnection between nodes can have a weight that is a set of parameters derived from the training of the neural network 600. Once the neural network 600 is trained, it can be referred to as a trained neural network, which can be used to classify one or more activities. For example, an interconnection between nodes can represent a piece of information learned about the interconnected nodes. The interconnection can have a tunable numeric weight that can be tuned (e.g., based on a training dataset), allowing the neural network 600 to be adaptive to inputs and able to learn as more and more data is processed.

The neural network 600 is pre-trained to process the features from the data in the input layer 620 using the different hidden layers 622*a*, 622*b*, through 622*n* in order to provide the output through the output layer 621.

In some cases, the neural network 600 can adjust the weights of the nodes using a training process called backpropagation. A backpropagation process can include a forward pass, a loss function, a backward pass, and a weight update. The forward pass, loss function, backward pass, and parameter/weight update is performed for one training iteration. The process can be repeated for a certain number of iterations for each set of training data until the neural network 600 is trained well enough so that the weights of the layers are accurately tuned.

To perform training, a loss function can be used to analyze error in the output. Any suitable loss function definition can be used, such as a Cross-Entropy loss. Another example of a loss function includes the mean squared error (MSE), defined as $E_total=\Sigma(\frac{1}{2}(target-output)^2)$. The loss can be set to be equal to the value of E_total.

The loss (or error) will be high for the initial training data since the actual values will be much different than the predicted output. The goal of training is to minimize the amount of loss so that the predicted output is the same as the training output. The neural network 600 can perform a backward pass by determining which inputs (weights) most contributed to the loss of the network, and can adjust the weights so that the loss decreases and is eventually minimized.

The neural network 600 can include any suitable deep network. One example includes a Convolutional Neural Network (CNN), which includes an input layer and an output layer, with multiple hidden layers between the input and out layers. The hidden layers of a CNN include a series of convolutional, nonlinear, pooling (for downsampling), and fully connected layers. The neural network 600 can include any other deep network other than a CNN, such as an autoencoder, Deep Belief Nets (DBNs), Recurrent Neural Networks (RNNs), among others.

As understood by those of skill in the art, machine-learning based classification techniques can vary depending on the desired implementation. For example, machine-learning classification schemes can utilize one or more of the following, alone or in combination: hidden Markov models; RNNs; CNNs; deep learning; Bayesian symbolic methods; Generative Adversarial Networks (GANs); support vector machines; image registration methods; and applicable rule-based systems. Where regression algorithms are used, they may include but are not limited to: a Stochastic Gradient Descent Regressor, a Passive Aggressive Regressor, etc.

Machine learning classification models can also be based on clustering algorithms (e.g., a Mini-batch K-means clustering algorithm), a recommendation algorithm (e.g., a Min-wise Hashing algorithm, or Euclidean Locality-Sensitive Hashing (LSH) algorithm), and/or an anomaly detection algorithm, such as a local outlier factor. Additionally, machine-learning models can employ a dimensionality reduction approach, such as, one or more of: a Mini-batch Dictionary Learning algorithm, an incremental Principal Component Analysis (PCA) algorithm, a Latent Dirichlet Allocation algorithm, and/or a Mini-batch K-means algorithm, etc.

Figure 7:
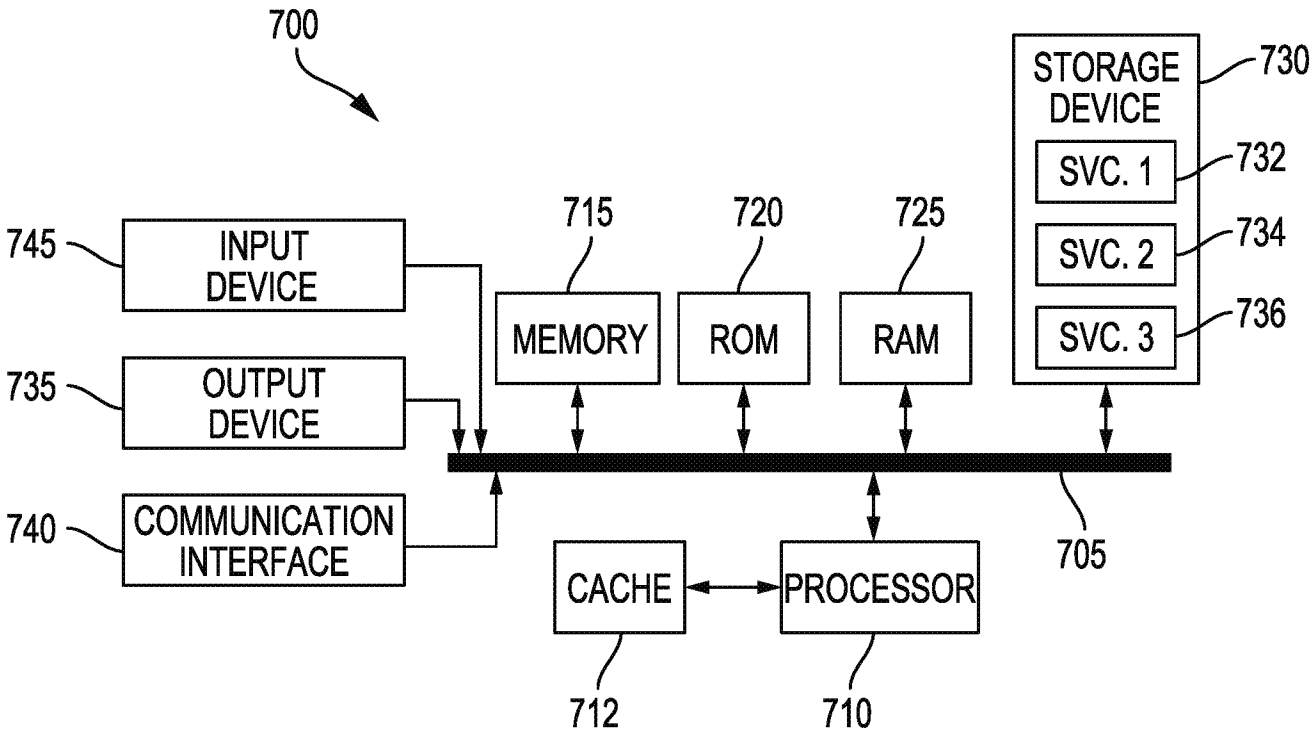
FIG. 7 illustrates an example computing device architecture which can be employed to perform various steps, methods, and techniques disclosed herein.

FIG. 7 illustrates an example computing device architecture 700 which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 7 illustrates an example computing device architecture 700 of a computing device which can implement the various technologies and techniques described herein. The components of the computing device architecture 700 are shown in electrical communication with each other using a connection 705, such as a bus. The example computing device architecture 700 includes a processing unit (CPU or processor) 710 and a computing device connection 705 that couples various computing device components including the computing device memory 715, such as read only memory (ROM) 720 and random access memory (RAM) 725, to the processor 710.

The computing device architecture 700 can include a cache of high-speed memory connected directly with, in close proximity to, or integrated as part of the processor 710. The computing device architecture 700 can copy data from the memory 715 and/or the storage device 730 to the cache 712 for quick access by the processor 710. In this way, the cache can provide a performance boost that avoids processor 710 delays while waiting for data. These and other modules can control or be configured to control the processor 710 to perform various actions. Other computing device memory 715 may be available for use as well. The memory 715 can include multiple different types of memory with different performance characteristics. The processor 710 can include any general purpose processor and a hardware or software service, such as service 1 732, service 2 734, and service 3 736 stored in storage device 730, configured to control the processor 710 as well as a special-purpose processor where software instructions are incorporated into the processor design. The processor 710 may be a self-contained system, containing multiple cores or processors, a bus, memory controller, cache, etc. A multi-core processor may be symmetric or asymmetric.

To enable user interaction with the computing device architecture 700, an input device 745 can represent any number of input mechanisms, such as a microphone for speech, a touch-sensitive screen for gesture or graphical input, keyboard, mouse, motion input, speech and so forth. An output device 735 can also be one or more of a number of output mechanisms known to those of skill in the art, such as a display, projector, television, speaker device, etc. In some instances, multimodal computing devices can enable a user to provide multiple types of input to communicate with the computing device architecture 700. The communications interface 740 can generally govern and manage the user input and computing device output. There is no restriction on operating on any particular hardware arrangement and therefore the basic features here may easily be substituted for improved hardware or firmware arrangements as they are developed.

Storage device 730 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 725, read only memory (ROM) 720, and hybrids thereof. The storage device 730 can include services 732, 734, 736 for controlling the processor 710. Other hardware or software modules are contemplated. The storage device 730 can be connected to the computing device connection 705. In one aspect, a hardware module that performs a particular function can include the software component stored in a computer-readable medium in connection with the necessary hardware components, such as the processor 710, connection 705, output device 735, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1. A method comprising: identifying a pump intake pressure after an intake for a submersible pump deployed downhole in a wellbore for pumping a substance out of the wellbore; accessing an intake loss prediction model for identifying a virtual intake loss associated with the intake for the submersible pump as a function of one or more intake loss parameters; identifying the virtual intake loss by applying the intake loss prediction model based on intake loss prediction input of the one or more intake loss parameters; and determining a pump intake pressure before the intake for the submersible pump based on the virtual intake loss and the identified pump intake pressure after the intake.

Statement 2. The method of statement 1, wherein the intake loss prediction model is a physical model and the one or more intake loss parameters includes a flowrate parameter.

Statement 3. The method of statements 1 and 2, wherein the input of the one or more intake loss parameters includes one or more values for the flowrate parameter.

Statement 4. The method of statements 1 through 3, further comprising: identifying a calculated intake loss across values of the flowrate parameter; and generating the physical model based on the calculated intake loss across the values of the flowrate parameter.

Statement 5. The method of statements 1 through 4, further comprising: determining a measured pump intake pressure before the intake across the values of the flowrate parameter; determining the pump intake pressure after the intake across the values of the flowrate parameter; and identifying the calculated intake loss across the values of the flowrate parameter based on the measured pump intake pressure before the intake and the identified pump intake pressure after the intake across the values of the flowrate parameter.

Statement 6. The method of statements 1 through 5, wherein the intake loss prediction model is a machine learning model and the one or more intake loss parameters include a flowrate parameter, a frequency parameter, a wellhead head parameter, a tubing loss parameter, a pump head parameter, or a combination thereof.

Statement 7. The method of statements 1 through 6, wherein the input of the one or more intake loss parameters includes one or more values for the flowrate parameter, the frequency parameter, the wellhead head parameter, the tubing loss parameter, the pump head parameter, or the combination thereof.

Statement 8. The method of statements 1 through 7, further comprising: identifying a calculated intake loss across values of the flowrate parameter, the frequency parameter, the wellhead head parameter, the tubing loss parameter, the pump head parameter, or the combination thereof; and generating the machine learning model to identify the virtual intake loss based on the calculated intake loss across the values of the flowrate parameter, the frequency parameter, the wellhead head parameter, the tubing loss parameter, the pump head parameter, or the combination thereof.

Statement 9. The method of statements 1 through 8, further comprising: determining a measured pump intake pressure before the intake across the values of the flowrate parameter, the frequency parameter, the wellhead head parameter, the tubing loss parameter, the pump head parameter, or the combination thereof; determining the pump intake pressure after the intake across the values of the flowrate parameter, the frequency parameter, the wellhead head parameter, the tubing loss parameter, the pump head parameter, or the combination thereof; and identifying the calculated intake loss across the values of the flowrate parameter, the frequency parameter, the wellhead head parameter, the tubing loss parameter, the pump head parameter, or the combination thereof based on the measured pump intake pressure before the intake and the identified pump intake pressure after the intake across the values of the flowrate parameter, the frequency parameter, the wellhead head parameter, the tubing loss parameter, the pump head parameter, or the combination thereof.

Statement 10. The method of statements 1 through 9, further comprising: determining a discharge head for the submersible pump; determining a total pump head for the submersible pump; and identifying the pump intake pressure after the intake for the submersible pump based on the discharge head and the total pump head for the submersible pump.

Statement 11. The method of statements 1 through 10, wherein the discharge head is determined based on a static head parameter for the submersible pump, a tubing loss parameter associated with the submersible pump deployed downhole in the wellbore, a wellhead head parameter, or a combination thereof.

Statement 12. The method of statements 1 through 11, wherein the total pump head for the submersible pump is determined based on either or both a flowrate parameter and an operating frequency parameter associated with the submersible pump deployed downhole in the wellbore.

Statement 13. A system comprising: a submersible pump deployed downhole in a wellbore for pumping a substance out of the wellbore; one or more processors; and at least one computer-readable storage medium having stored therein instructions which, when executed by the one or more processors, cause the one or more processors to: identify a pump intake pressure after an intake for the submersible pump; access an intake loss prediction model for identifying a virtual intake loss associated with the intake for the submersible pump as a function of one or more intake loss parameters; identify the virtual intake loss by applying the intake loss prediction model based on intake loss prediction input of the one or more intake loss parameters; and determine a pump intake pressure before the intake for the submersible pump based on the virtual intake loss and the identified pump intake pressure after the intake.

Statement 14. The method of statement 13, wherein the intake loss prediction model is a physical model and the one or more intake loss parameters includes a flowrate parameter.

Statement 15. The method of statements 13 and 14, wherein the instructions further cause the one or more processors to: identify a calculated intake loss across values of the flowrate parameter; and generate the physical model to predict the intake loss based on the calculated intake loss across the values of the flowrate parameter.

Statement 16. The method of statements 13 through 15, wherein the instructions further cause the one or more processors to: determine a measured pump intake pressure before the intake across the values of the flowrate parameter; determine the pump intake pressure after the intake across the values of the flowrate parameter; and identify the calculated intake loss across the values of the flowrate parameter based on the measured pump intake pressure before the intake and the identified pump intake pressure after the intake across the values of the flowrate parameter.

Statement 17. The method of statements 13 through 16, wherein the intake loss prediction model is a machine learning model and the one or more intake loss parameters include a flowrate parameter, a frequency parameter, a wellhead head parameter, a tubing loss parameter, a pump head parameter, or a combination thereof.

Statement 18. The method of statements 13 through 17, wherein the instructions further cause the one or more processors to: identify a calculated intake loss across values of the flowrate parameter, the frequency parameter, the wellhead head parameter, the tubing loss parameter, the pump head parameter, or the combination thereof; and generate the machine learning model to predict the intake loss based on the calculated intake loss across the values of the flowrate parameter, the frequency parameter, the wellhead head parameter, the tubing loss parameter, the pump head parameter, or the combination thereof.

Statement 19. The method of statements 13 through 18, wherein the instructions further cause the one or more processors to: determine a measured pump intake pressure before the intake across the values of the flowrate parameter, the frequency parameter, the wellhead head parameter, the tubing loss parameter, the pump head parameter, or the combination thereof; determine the pump intake pressure after the intake across the values of the flowrate parameter, the frequency parameter, the wellhead head parameter, the tubing loss parameter, the pump head parameter, or the combination thereof; and identify the calculated intake loss across the values of the flowrate parameter, the frequency parameter, the wellhead head parameter, the tubing loss parameter, the pump head parameter, or the combination thereof based on the measured pump intake pressure before the intake and the identified pump intake pressure after the intake across the values of the flowrate parameter, the frequency parameter, the wellhead head parameter, the tubing loss parameter, the pump head parameter, or the combination thereof.

Statement 20. A non-transitory computer-readable storage medium having stored therein instructions which, when executed by one or more processors, cause the one or more processors to: identify a pump intake pressure after an intake for a submersible pump deployed downhole in a wellbore for pumping a substance out of the wellbore; access an intake loss prediction model for identifying a virtual intake loss associated with the intake for the submersible pump as a function of one or more intake loss parameters; identify the virtual intake loss by applying the intake loss prediction model based on intake loss prediction input of the one or more intake loss parameters; and determine a pump intake pressure before the intake for the submersible pump based on the virtual intake loss and the identified pump intake pressure after the intake.

Statement 21. A system comprising means for performing a method according to any of Statements 1 through 12.

What is claimed is:

1. A method comprising:

identifying a pump intake pressure after an intake for a submersible pump deployed downhole in a wellbore for pumping a substance out of the wellbore;

accessing an intake loss prediction model for identifying a virtual intake loss associated with the intake for the submersible pump as a function of one or more intake loss parameters;

identifying the virtual intake loss by applying the intake loss prediction model based on intake loss prediction input of the one or more intake loss parameters;

determining a pump intake pressure before the intake for the submersible pump based on the virtual intake loss and the identified pump intake pressure after the intake; and pumping, by the submersible pump, the substance out of the wellbore based on the determined pump intake pressure before the intake.

2. The method of claim 1, wherein the intake loss prediction model is a physical model and the one or more intake loss parameters includes a flowrate parameter.

3. The method of claim 2, wherein the input of the one or more intake loss parameters includes one or more values for the flowrate parameter.

4. The method of claim 2, further comprising:

identifying a calculated intake loss across values of the flowrate parameter; and generating the physical model based on the calculated intake loss across the values of the flowrate parameter.

5. The method of claim 4, further comprising:

determining a measured pump intake pressure before the intake across the values of the flowrate parameter;

determining the pump intake pressure after the intake across the values of the flowrate parameter; and identifying the calculated intake loss across the values of the flowrate parameter based on the measured pump intake pressure before the intake and the identified pump intake pressure after the intake across the values of the flowrate parameter.

6. The method of claim 1, wherein the intake loss prediction model is a machine learning model and the one or more intake loss parameters include a flowrate parameter, a frequency parameter, a wellhead head parameter, a tubing loss parameter, a pump head parameter, or a combination thereof.

7. The method of claim 6, wherein the input of the one or more intake loss parameters includes one or more values for the flowrate parameter, the frequency parameter, the wellhead head parameter, the tubing loss parameter, the pump head parameter, or the combination thereof.

8. The method of claim 6, further comprising:

identifying a calculated intake loss across values of the flowrate parameter, the frequency parameter, the wellhead head parameter, the tubing loss parameter, the pump head parameter, or the combination thereof; and generating the machine learning model to identify the virtual intake loss based on the calculated intake loss across the values of the flowrate parameter, the frequency parameter, the wellhead head parameter, the tubing loss parameter, the pump head parameter, or the combination thereof.

9. The method of claim 8, further comprising:

determining a measured pump intake pressure before the intake across the values of the flowrate parameter, the frequency parameter, the wellhead head parameter, the tubing loss parameter, the pump head parameter, or the combination thereof;

determining the pump intake pressure after the intake across the values of the flowrate parameter, the frequency parameter, the wellhead head parameter, the tubing loss parameter, the pump head parameter, or the combination thereof; and identifying the calculated intake loss across the values of the flowrate parameter, the frequency parameter, the wellhead head parameter, the tubing loss parameter, the pump head parameter, or the combination thereof based on the measured pump intake pressure before the intake and the identified pump intake pressure after the intake across the values of the flowrate parameter, the frequency parameter, the wellhead head parameter, the tubing loss parameter, the pump head parameter, or the combination thereof.

10. The method of claim 1, further comprising:

determining a discharge head for the submersible pump;

determining a total pump head for the submersible pump; and identifying the pump intake pressure after the intake for the submersible pump based on the discharge head and the total pump head for the submersible pump.

11. The method of claim 10, wherein the discharge head is determined based on a static head parameter for the submersible pump, a tubing loss parameter associated with the submersible pump deployed downhole in the wellbore, a wellhead head parameter, or a combination thereof.

12. The method of claim 10, wherein the total pump head for the submersible pump is determined based on either or both a flowrate parameter and an operating frequency parameter associated with the submersible pump deployed downhole in the wellbore.

13. A system comprising:

a submersible pump deployed downhole in a wellbore for pumping a substance out of the wellbore;

one or more processors; and at least one computer-readable storage medium having stored therein instructions which, when executed by the one or more processors, cause the one or more processors to:

identify a pump intake pressure after an intake for the submersible pump;

access an intake loss prediction model for identifying a virtual intake loss associated with the intake for the submersible pump as a function of one or more intake loss parameters;

identify the virtual intake loss by applying the intake loss prediction model based on intake loss prediction input of the one or more intake loss parameters;

determine a pump intake pressure before the intake for the submersible pump based on the virtual intake loss and the identified pump intake pressure after the intake; and pump, by the submersible pump, the substance out of the wellbore based on the determined pump intake pressure before the intake.

14. The system of claim 13, wherein the intake loss prediction model is a physical model and the one or more intake loss parameters includes a flowrate parameter.

15. The system of claim 14, wherein the instructions further cause the one or more processors to:

identify a calculated intake loss across values of the flowrate parameter; and generate the physical model to predict the intake loss based on the calculated intake loss across the values of the flowrate parameter.

16. The system of claim 15, wherein the instructions further cause the one or more processors to:

determine a measured pump intake pressure before the intake across the values of the flowrate parameter;

determine the pump intake pressure after the intake across the values of the flowrate parameter; and identify the calculated intake loss across the values of the flowrate parameter based on the measured pump intake pressure before the intake and the identified pump intake pressure after the intake across the values of the flowrate parameter.

17. The system of claim 13, wherein the intake loss prediction model is a machine learning model and the one or more intake loss parameters include a flowrate parameter, a frequency parameter, a wellhead head parameter, a tubing loss parameter, a pump head parameter, or a combination thereof.

18. The system of claim 17, wherein the instructions further cause the one or more processors to:

identify a calculated intake loss across values of the flowrate parameter, the frequency parameter, the wellhead head parameter, the tubing loss parameter, the pump head parameter, or the combination thereof; and generate the machine learning model to predict the intake loss based on the calculated intake loss across the values of the flowrate parameter, the frequency parameter, the wellhead head parameter, the tubing loss parameter, the pump head parameter, or the combination thereof.

19. The system of claim 18, wherein the instructions further cause the one or more processors to:

determine a measured pump intake pressure before the intake across the values of the flowrate parameter, the frequency parameter, the wellhead head parameter, the tubing loss parameter, the pump head parameter, or the combination thereof;

determine the pump intake pressure after the intake across the values of the flowrate parameter, the frequency parameter, the wellhead head parameter, the tubing loss parameter, the pump head parameter, or the combination thereof; and identify the calculated intake loss across the values of the flowrate parameter, the frequency parameter, the wellhead head parameter, the tubing loss parameter, the pump head parameter, or the combination thereof based on the measured pump intake pressure before the intake and the identified pump intake pressure after the intake across the values of the flowrate parameter, the frequency parameter, the wellhead head parameter, the tubing loss parameter, the pump head parameter, or the combination thereof.

20. A non-transitory computer-readable storage medium having stored therein instructions which, when executed by one or more processors, cause the one or more processors to:

identify a pump intake pressure after an intake for a submersible pump deployed downhole in a wellbore for pumping a substance out of the wellbore;

access an intake loss prediction model for identifying a virtual intake loss associated with the intake for the submersible pump as a function of one or more intake loss parameters;

identify the virtual intake loss by applying the intake loss prediction model based on intake loss prediction input of the one or more intake loss parameters;

determine a pump intake pressure before the intake for the submersible pump based on the virtual intake loss and the identified pump intake pressure after the intake; and pump, by the submersible pump, the substance out of the wellbore based on the determined pump intake pressure before the intake.

* * * * *